US007658689B2

(12) United States Patent
Crook, II

(10) Patent No.: US 7,658,689 B2
(45) Date of Patent: Feb. 9, 2010

(54) ULTIMATE DEFENDER

(76) Inventor: Robert E. Crook, II, R.R. 1, P.O. Box 514, Altoona, PA (US) 16601

( * ) Notice: Subject to any disclaimer, the term of this patent is extended or adjusted under 35 U.S.C. 154(b) by 147 days.

(21) Appl. No.: 11/974,855

(22) Filed: Oct. 15, 2007

(65) Prior Publication Data

US 2009/0098955 A1 Apr. 16, 2009

(51) Int. Cl.
*A63B 69/00* (2006.01)
*A63B 69/34* (2006.01)

(52) U.S. Cl. ..... 473/447; 473/438; 473/422

(58) Field of Classification Search ..... 473/422, 473/438, 444, 441, 445, 448, 446; 434/247, 434/250, 251; 482/4, 83–90; D21/621, 781; D19/59

See application file for complete search history.

(56) References Cited

U.S. PATENT DOCUMENTS 3,675,921 A * 7/1972 Meyers, Sr. ..... 473/448
3,804,406 A * 4/1974 Viscione ..... 482/4
4,088,315 A * 5/1978 Schemmel ..... 482/4
D269,882 S * 7/1983 Leverton ..... D19/59
4,989,862 A * 2/1991 Curtis ..... 473/448
5,527,185 A * 6/1996 Davis ..... 473/438
5,700,230 A * 12/1997 Cardona ..... 482/83
5,772,538 A * 6/1998 Sztykiel et al. ..... 473/446
6,155,960 A * 12/2000 Roberts et al. ..... 482/83
6,159,111 A * 12/2000 Purcell ..... 473/422
6,579,197 B2 * 6/2003 Benoit ..... 473/447
7,070,521 B2 * 7/2006 Bayduke ..... 473/438
7,131,917 B2 * 11/2006 Spencer ..... 473/444
D539,373 S * 3/2007 Cook ..... D21/781
7,491,139 B2 * 2/2009 Bridge et al. ..... 473/422

* cited by examiner

*Primary Examiner*—Mitra Aryanpour
(74) *Attorney, Agent, or Firm*—Richard K. Thomson

(57) ABSTRACT

A training assistance device capable of significant height adjustment has at least one adjustable, and preferably, two adjustable arms to allow it to simulate a defender in a variety of sports including baseball, basketball, football, hockey, soccer, and volleyball. Structure facilitating transport of the device from place to place is included.

6 Claims, 5 Drawing Sheets

ULTIMATE DEFENDER

BACKGROUND AND SUMMARY OF THE INVENTION

The present invention is directed to the field of sports. More particularly, the present invention is directed to an adjustable dummy for use in baseball, basketball, football, soccer, volleyball and similar sports where shooting/kicking/serving/throwing over/around an opponent is necessary to achieve an objective, e.g., passing or scoring.

A number of devices are available for assisting basketball players in learning to shoot over a defender's outstretched hands. For example, U.S. Pat. No. 6,159,111 to Purcell and U.S. Pat. No. 5,485,993 to Lipsett teach adjustable devices for use in training shooters to deal with such impediments. Other devices are designed to train the B-baller in making more precise passes. For example, U.S. Pat. No. 6,579,197 to Benoit includes a trampoline passing target. Still other devices, such as U.S. Pat. No. 7,070,521, are designed to simulate rushing linemen for place kickers. Finally, at least one device taught in U.S. Pat. No. 5,527,185 to Davis contemplates multiple sport application, albeit by means of alternate configurations.

None of the prior art devices provides the versatility of the present invention in such a light weight, mobile dummy. The training assistance device of the present invention comprises an adjustable figurine with a wheeled base which enables it to be easily moved from a use position to a non-use, stored position as well as from field to basketball court for one of its various applications. The figurine may not only be adjusted to a plurality of heights, its arms may be easily positioned in any of six different adjustments to defend shots, passes, place kicks, punts, double play throws and a variety of soccer kicks, headers, etc.

The present invention is being marketed under the trademark the ULTIMATE DEFENDER. This invention comprises a training assistance device for use in developing proper technique for punters, kickers, passers, servers, and shooters in the sports of baseball, basketball, football, soccer, volleyball, and the like, said training assistance device comprising a) a manikin impersonating a defender, the manikin including i) a leg portion; ii) a torso portion; iii) adjustable mounting means positioned between the leg portion and the torso portion enabling a height of the manikin to be adjusted between a plurality of positions; iv) at least one arm secured to the torso portion; v) adjustable attachment means securing the at least one arm to the torso portion, the adjustable attachment means permitting positioning of the at least one arm means in one of a plurality of angular orientations; vi) a base attached to and supporting said leg portion; vii) transport assist means attached to one of the base, the leg portion and the torso portion facilitating movement of the training assistance device from place to place.

The torso portion is preferably tilted slightly forward relative to the leg portion simulating a forward press of a defender. Further, the torso portion has two shoulder sections and the at least one arm comprises at least two arms, one connected to each of the two shoulder sections. The adjustable attachment means for the at least one arm is effected by polygonally shaped fastener having n external faces fitting in a similarly configured opening in the arm enabling the arm to be adjusted to n different angular positions. The transport assist means preferably takes the form of wheels affixed to the base. In the preferred embodiment, a pair of axle-mounted casters are secured to the rear portion of the base.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
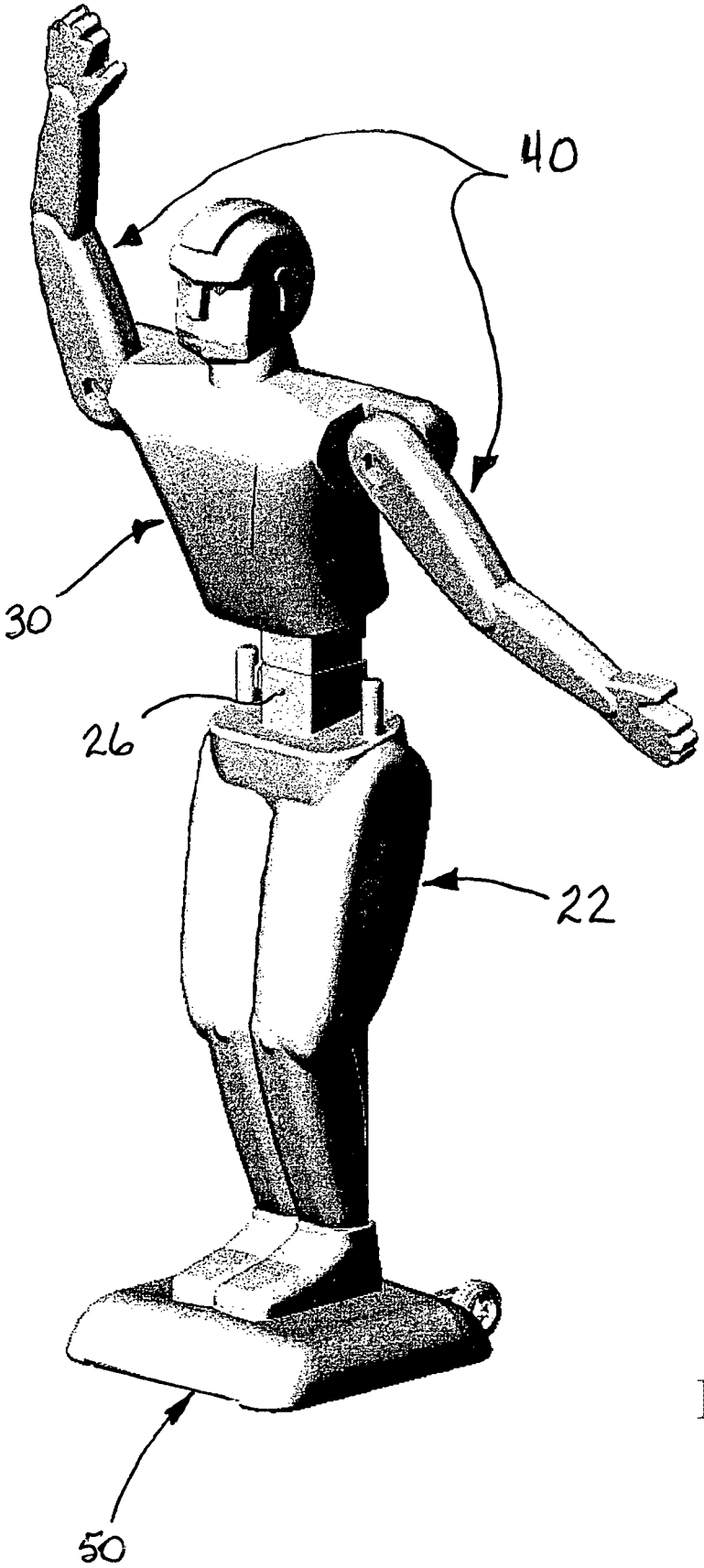
FIG. 1 is a perspective front view of a first embodiment of the of the training assistance device of the present invention.
Figure 2:
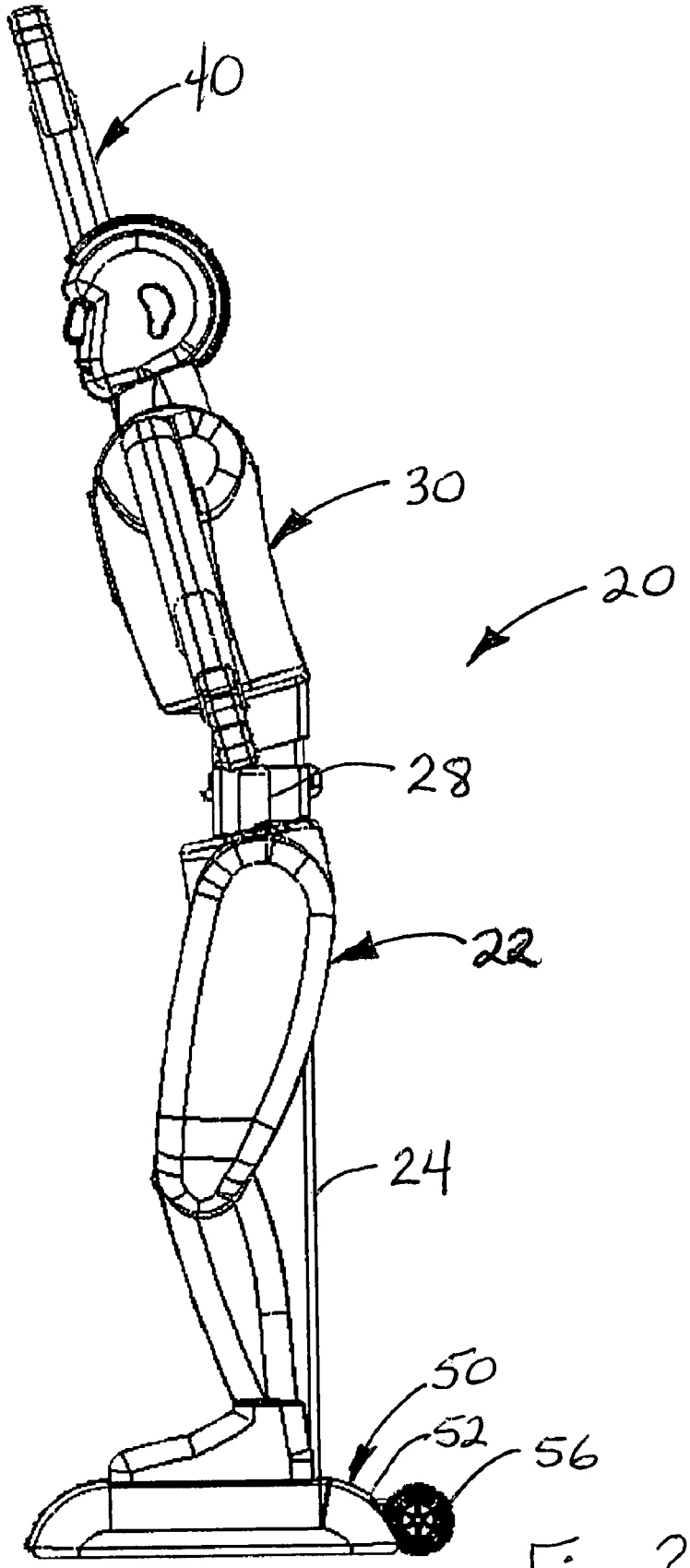
FIG. 2 is a side view of the first embodiment.
Figure 3:
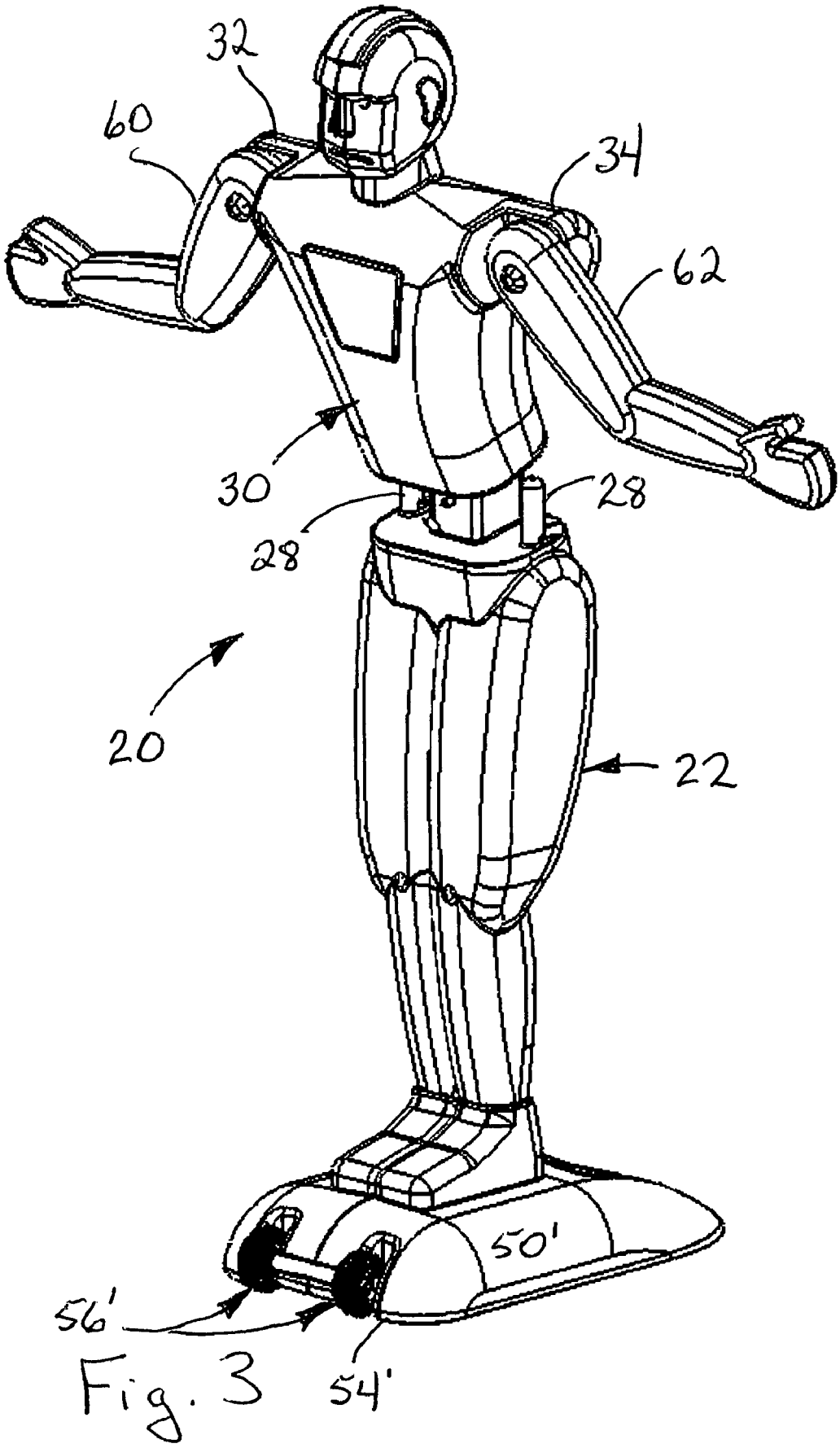
FIG. 3 is a schematic front perspective view of a second embodiment.
Figure 4:
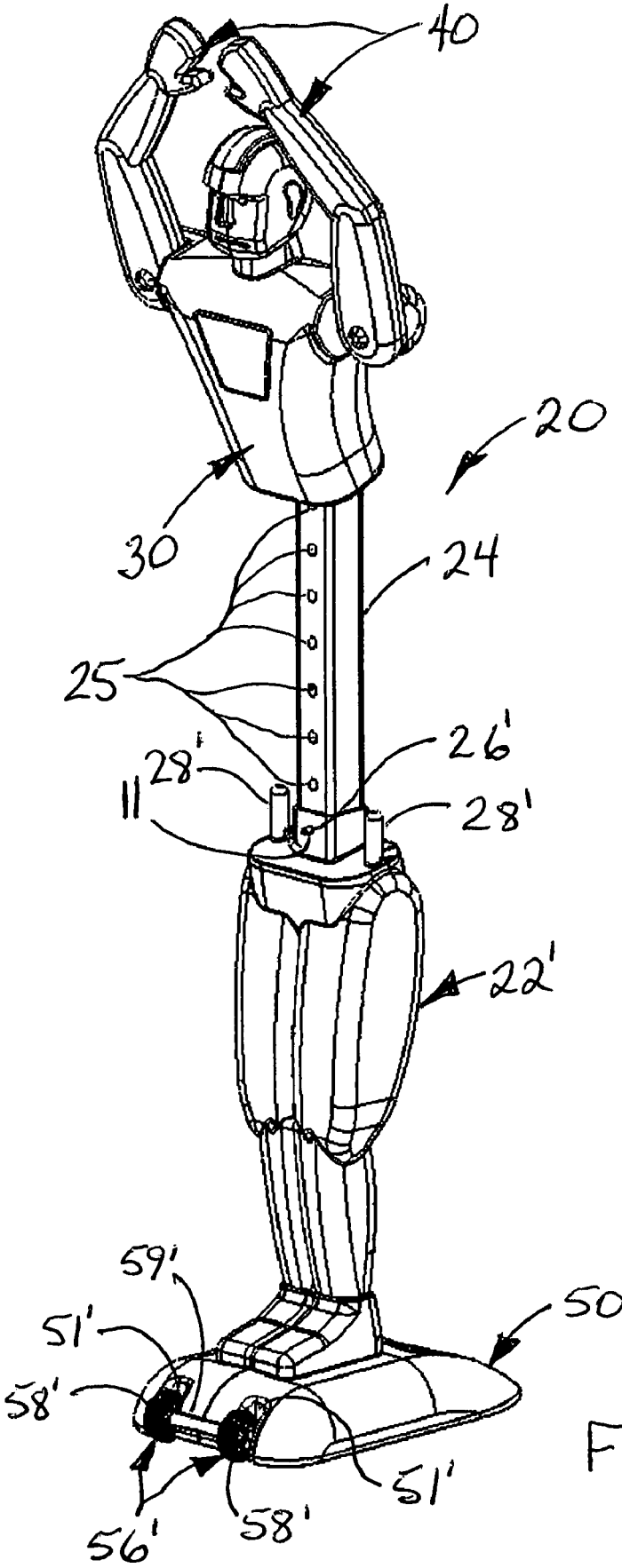
FIG. 4 is a schematic front perspective of the second embodiment shown in its extending position; and, FIG. 5 is a schematic partial front view depicting several of the arm adjustment positions.

A first embodiment of the training assistance device is depicted in FIGS. 1-5 generally at 20. The training assistance device 20 is preferably configured as a dummy or manikin simulating a defensive player. Manikin 20 comprises a leg portion 22, a torso portion 30, at least one arm means 40 and a base 50. Manikin 20 is designed to be life size, standing some 6'3" tall on base 50. As seen in FIG. 4, an extendible pedestal 24 interconnects leg portion 22 and torso portion 30 allowing the ULTIMATE DEFENDER to be extended to a height of 8'4" with a maximum reach approaching 10'. Dimensions are, of course, by way of example and not limitation. Pin 11 can be inserted through the DEFENDER's "navel" 26 into one a plurality of holes 25 in the pedestal 24 to vary his height, as desired.

Preferably, torso portion 30 has a slight tilt with respect to leg portion 22 to mimic the forward press of an actual defender. A pair of handles 28 are positioned atop the leg portion 22 to facilitate manipulation of the ULTIMATE DEFENDER 20. Further facilitating movement from place to place is transport assist means which, in this first preferred embodiment, takes the form of wheel means 56 attached to back edge 52 of base 50. In a second embodiment depicted in FIGS. 3-4, wheel means 56' are positioned on front edge 54' of base 50'. As shown there, wheel means 56' comprise a pair of wheels 58' mounted on axle 59'. Even more preferably, wheels 58' could be mounted on two separate stub axles which fit in recesses (not shown) formed in the sides of slots 51'.

Figure 5:
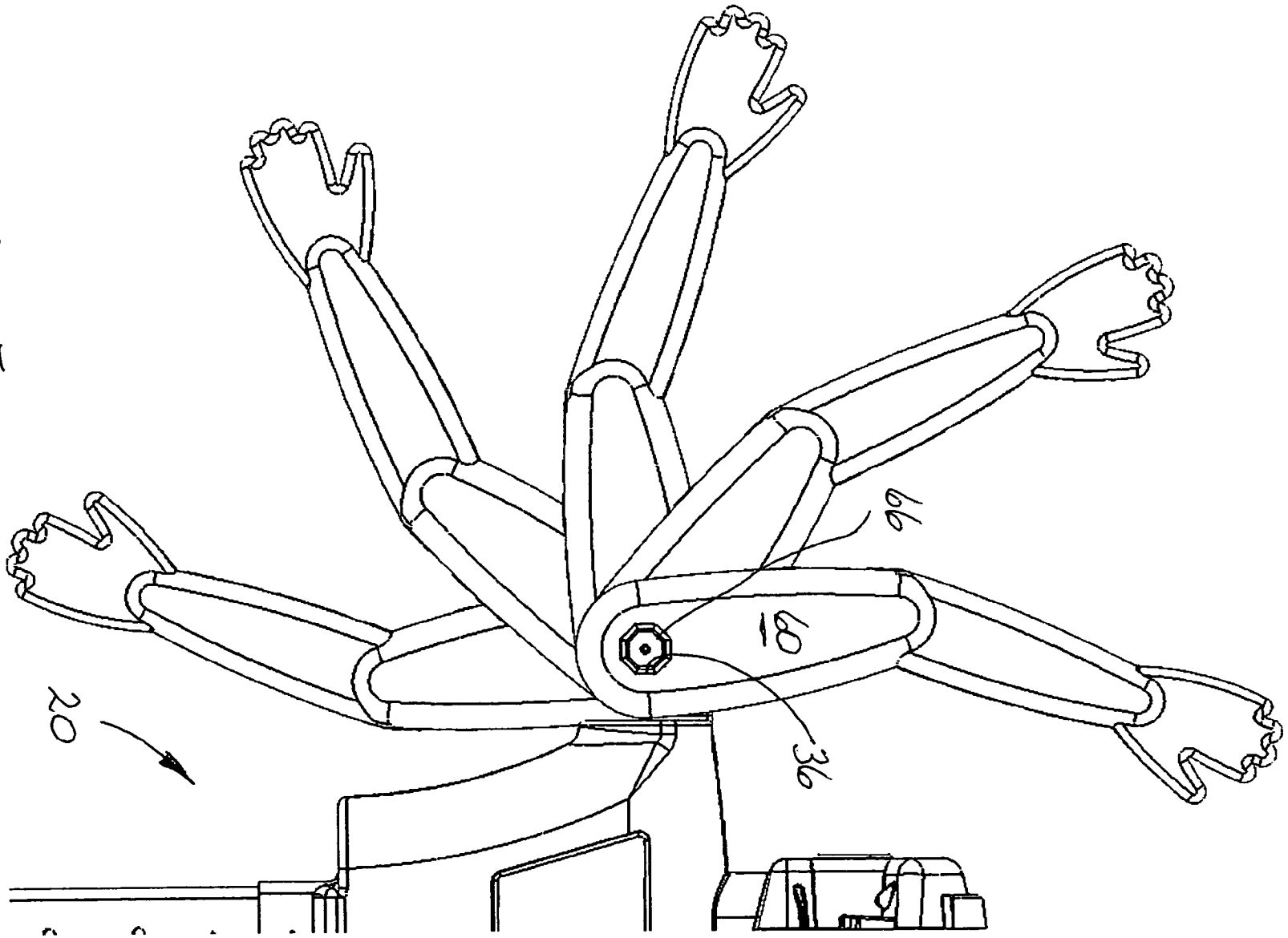

Torso portion 30 has two shoulder sections 32, 34 which receive two arms 60, 62, at least one of which is adjustable. More preferably, both arms are adjustable by means of fasteners 66 received in recesses 36 in arms 60, 62. As best seen in FIG. 5, a polygonally headed fastener 66 having 'n' external peripheral faces is received in like shaped recesses 36 to provide 'n' distinct angular positions. By way of example and not limitation, fastener 66 is shown with eight peripheral faces providing 8 distinct positions (although 3 of the 8 will be within the outline of the body and not normally used). Alternatively, arms 60, 62 could be attached with a conventional bolt which did not fit snugly within recess 36 providing unlimited number of positions within the range of motion.

For use by punters, kickers, volleyball servers, basketball shooters, the ULTIMATE DEFENDER 20 will normally be extended to the height of the players against whom s/he competes (or slightly taller to account for leaping) with hands directed overhead as shown in FIG. 4. However, when practicing double plays, the second baseman will typically leave DEFENDER 20 at its unextended height (FIG. 3) with arms/hands outstretched or positioned more toward its sides (to ensure clearance). A soccer kicker practicing avoiding a goalie, may wish to leave the DEFENDER 20 at its unextended (or slightly extended height) with one hand extended upwardly and one outstretched (FIG. 1) to practice hitting both the upper and lower corners of the goal. The versatility afforded by the ULTIMATE DEFENDER 20 enables it to provide beneficial training to a wide range of athletes/age groups participating in a wide range of sports. No team/sports program should be without one!

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A training assistance device for use in developing proper technique for punters, kickers, passers, servers, and shooters in the sports of basketball, football, soccer, volleyball, and the like, said training assistance device comprising a) a manikin impersonating a defender, said manikin including i) a leg portion;

ii) a torso portion;

iii) adjustable mounting means positioned between said leg portion and said torso portion enabling a height of said manikin to be adjusted between a plurality of positions, a height variation accomplished by said adjustment exceeding a maximum amount of two feet;

iv) at least one arm secured to said torso portion;

v) adjustable attachment means securing said at least one arm to said torso portion for rotation about a horizontal axis, said adjustable attachment means pennitting positioning of said at least one arm means in one of a plurality of angular orientations so that said arm may rotate in a plane parallel to the face of the torso;

vi) a base attached to and supporting said leg portion, capable of supporting said manikin when fully extended;

vii) transport assist means attached to one of said base, said leg portion and said torso portion facilitating movement of said training assistance device from place to place.

2. The training assistance device of claim 1 wherein said torso portion is tilted slightly forward relative to said leg portion simulating a forward press of a defender.

3. The training assistance device of claim 1 wherein said torso portion has two shoulder sections and said at least one arm comprises at least two arms, one connected to each of said two shoulder sections, each arm easily adjusted between six annular positions.

4. The training assistance device of claim 1 wherein said adjustable mounting means comprises a square pedestal attached to one of said leg portion and said torso portion and a square receptacle attached to another of said leg portion and said torso portion for receiving said square pedestal.

5. The training assistance device of claim 1 wherein said transport assist means comprises a pair of axle-mounted casters secured to a rear side of said base portion, said caster extending outwardly from said base portion by nearly a full diameter of said casters.

6. The training assistance device of claim 1 wherein said adjustable attachment means comprises an exposed polygonally shaped fastener having a first plurality n of external faces, an exposed polygonally shaped opening in said at least one arm, said polygonally shaped opening having a second plurality of internal faces, said second plurality being equal in number to said first plurality, said adjustable attachment means permitting said at least one arm to be firmly secured in a plane parallel to the face of the torso in any of n number of different angular orientations.

* * * * *